US005944164A

United States Patent [19]

Behle

[11] Patent Number: 5,944,164

[45] Date of Patent: Aug. 31, 1999

[54] ASSEMBLY METHOD FOR STEPS OR PALLETS OF ESCALATORS OR MOVING SIDEWALKS

[75] Inventor: Fritz Behle, Barssel, Germany

[73] Assignee: O&K Rolltreppen GmbH & Co. KG, Hattingen, Germany

[21] Appl. No.: 09/244,033

[22] Filed: Feb. 4, 1999

Related U.S. Application Data

[62] Division of application No. 08/808,044, Mar. 4, 1997.

[30] Foreign Application Priority Data

Mar. 4, 1996 [DE] Germany ..... 198 08 169

[51] Int. Cl.[6] ..... B66B 23/12

[52] U.S. Cl. ..... 198/333; 198/327

[58] Field of Search ..... 198/321, 326, 198/327, 332, 333

[56] References Cited

U.S. PATENT DOCUMENTS 5,293,982 3/1994 Ahls et al. .
5,358,089 10/1994 Riedel .

FOREIGN PATENT DOCUMENTS 0 490 591 A2 6/1992 European Pat. Off. .
0 606 990 A1 7/1994 European Pat. Off. .
551 716 6/1932 Germany .
2 342 849 3/1994 Germany .
5-793 1/1993 Japan .

*Primary Examiner*—James R. Bidwell
*Attorney, Agent, or Firm*—Venable; George H. Spencer; Robert Kinberg

[57] ABSTRACT

A method for the assembly/dismantling of axles and/or the steps or pallets of escalators or moving sidewalks includes providing between parallel extending traction elements a plurality of axles and connecting the axles to the traction elements. The axles are provided with flattened zones in assembly regions for the steps or pallets and the assembly regions are provided, respectively, with an approximately eyelet-shape designed that has a corresponding slot fitted onto the respective flattened zones of the axles. The axles are turned at a predetermined angle around their longitudinal axis relative to the steps or pallets and subsequently at least one connecting element is inserted into a respective one of the assembly regions for securing the axles relative to the steps or pallets.

5 Claims, 4 Drawing Sheets

ASSEMBLY METHOD FOR STEPS OR PALLETS OF ESCALATORS OR MOVING SIDEWALKS

CROSS-REFERENCE TO RELATED APPLICATION

This application is a division of U.S. Application Ser. No. 08/808,044, filed Mar. 4, 1997.

This application claims the priority of Patent Application Ser. No. 196 08 169.6, filed in Germany on Mar. 4, 1996, the subject matter of which is incorporated herein by reference.

BACKGROUND OF THE INVENTION

The invention relates to a method for the assembly/dismantling of the axles and/or the steps or pallets of escalators or moving sidewalks.

German patent document DE-A 551 716 concerns an endless transporting device for continuous operation, in particular a mechanical stairs with two halves that move in opposite directions. The transporting device comprises two endless chains, the links of which are interconnected with spherical joints and are connected via additional spherical joints to strut axles [bracing axles], which function as axis of rotation for a portion of the transporting device, for example for a step. The side walls of the stair step element are each provided with an opening, the diameter of which corresponds to the outside diameter of the cylindrical sleeves and for which the narrowing of the width corresponds to the axle diameter. The axles are interconnected in pairs with a pin, next to the outer chain links of the traction chain. The step is inserted with its openings into the sleeves, which themselves are kept at the required distance by the strut.

German patent document DE-A 23 42 849 concerns a fastening device for the steps of an escalator or the like on the crossbars that are connected to the conveying chains. Provided is at least one clamp with two clamping jaws, one of which is connected so tightly with the stair step that it fits itself against the respective crossbar during the insertion of a step from one side. The other clamping jaw is connected movably to the step such that this clamping jaw comes to rest automatically against the other side of the crossbar when inserting the step. A device for locking the clamping jaws in a position that spans the crossbar is accessible directly from the outside in order to release it.

A positioning of the pallets for moving sidewalks on corresponding axle elements is known from the European patent document EP-A 490 591. These extend between the parallel running traction elements. A split bearing is used, which extends between the respective axle and the associated pallet. As a result of a corresponding shaping of the divided bearing, a relative motion between pallet and bearing is not possible.

For all known solutions, the assembly or dismantling of steps or pallets and/or the receiving axles for escalators or moving sidewalks is a relatively involved process.

It is an object of the invention to develop a method for the assembly/dismantling of the axles and/or the steps or pallets of escalators or moving sidewalks with simple structural design, which permits the assembly/dismantling of the steps or pallets and/or the axles that hold them between the chain strands in the escalator or inside of the moving sidewalk by using simple means. Furthermore, a fastening device for the steps or pallets of escalators or moving sidewalks is to be provided, which permits a simplified assembly of the steps or pallets and/or their axles without requiring additional structural components. Furthermore, this is also intended to provide the option of replacing existing equipment without problems.

SUMMARY OF THE INVENTION

This object and others are achieved by a method for the assembly/dismantling of the axles and/or steps or pallets of escalators or moving sidewalks by providing between the parallel running traction elements a plurality of axles, comprised if necessary of several component parts but forming a continuous axle in the installed position, which are connected to the traction elements and the rollers possibly arranged there, wherein the axles provided in the assembly region for the steps or pallets have flattened zones, wherein the approximately eyelet-shaped assembly regions for the steps or pallets that are provided with corresponding slots are slipped over the flattened zones of the axles and the axles are turned at a preset angle around their longitudinal axis relative to the steps or pallets and wherein subsequently at least one connecting element for securing the axles relative to the steps or pallets is inserted into the assembly region.

According to another aspect of the invention, there is provided a fastening device for steps or pallets of escalators or moving sidewalks, having axles between the parallel running traction elements that may be composed of several individual parts, but which form continuous axles when installed, as well as steps or pallets provided with receiving openings for the axles, wherein the receiving openings are constituted by approximately eyelet-shaped assembly regions of the steps or pallets which comprise a slot with approximately parallel-extending surfaces, the axles in the assembly region have approximately parallel-extending flattened zones, the thickness of the flattened zones corresponding approximately to the spacing for the areas in the region of the receiving openings, such that by fitting the slotted assembly regions onto the flattened zones and subsequently turning the axles around their longitudinal axis relative to the steps or pallets, a form-locking connection can be established between the axles and the steps or pallets.

With the inventive measure, it is possible to assemble or dismantle the steps or pallets in a simple way between the traction elements within the escalator or the moving sidewalk, without having to remove the associated axles.

As already addressed, the axles are provided with additional flattened zones in the assembly region for the steps or pallets, e.g. through milling or the like. The assembly region on the steps or pallets, which as a rule is cast on and has a cylindrical cross section, is cut open with a simple tool, which results in two, approximately parallel surfaces. As a result, the steps of pallets can be assembled/dismantled easily by simply fitting these slotted regions onto the flattened zones on the axles. A form-locking connection is established between the steps or pallets and the associated axles by a relative motion of the respective axle, so that the flattened zones of the axle subsequently come to rest outside of the slot. Thus, it is not possible for the thicker and as a rule cylinder-shaped axle region, to slip from the slotted region of the eyelet-shaped assembly region. For reasons of safety and if the form-locking connection is not considered to be sufficient, a connecting element can be inserted from the outside into the assembly region and the twisted axle.

The dismantling then takes place in the reverse order, wherein the connecting element between the assembly region for the step or pallet and the associated axle must first be removed. The axle is subsequently turned back to its original position and can very simply be lifted off the axles because the flattened zones are once more positioned parallel to each other. Even if in one case a connecting element should accidentally not be used, at least one additional connecting element exists in the additional assembly region or regions for the step or pallet, so that the axle cannot turn by itself in the direction of the slot.

In order to simplify the assembly/dismantling of the axles, the axles are preferably designed in two parts, wherein the individual parts are provided to be tube-shaped and can be moved relative to each other in longitudinal direction. By using connecting means that are designed as screws, bolts or the like, it is possible to move the individual parts until they reach a defined length and secure them relative to each other with the connecting means. This is particularly useful if deviations in the spacing exist in the continued course of the traction elements. These tolerances can be balanced or adjusted without problem through the option of moving the individual parts relative to each other.

BRIEF DESCRIPTION OF THE DRAWINGS

These and other features and advantages of the invention will be further understood from the following detailed description of the preferred embodiments with reference to the accompanying drawings in which.

DETAILED DESCRIPTION OF THE PREFERRED EMBODIMENTS

Figure 1:
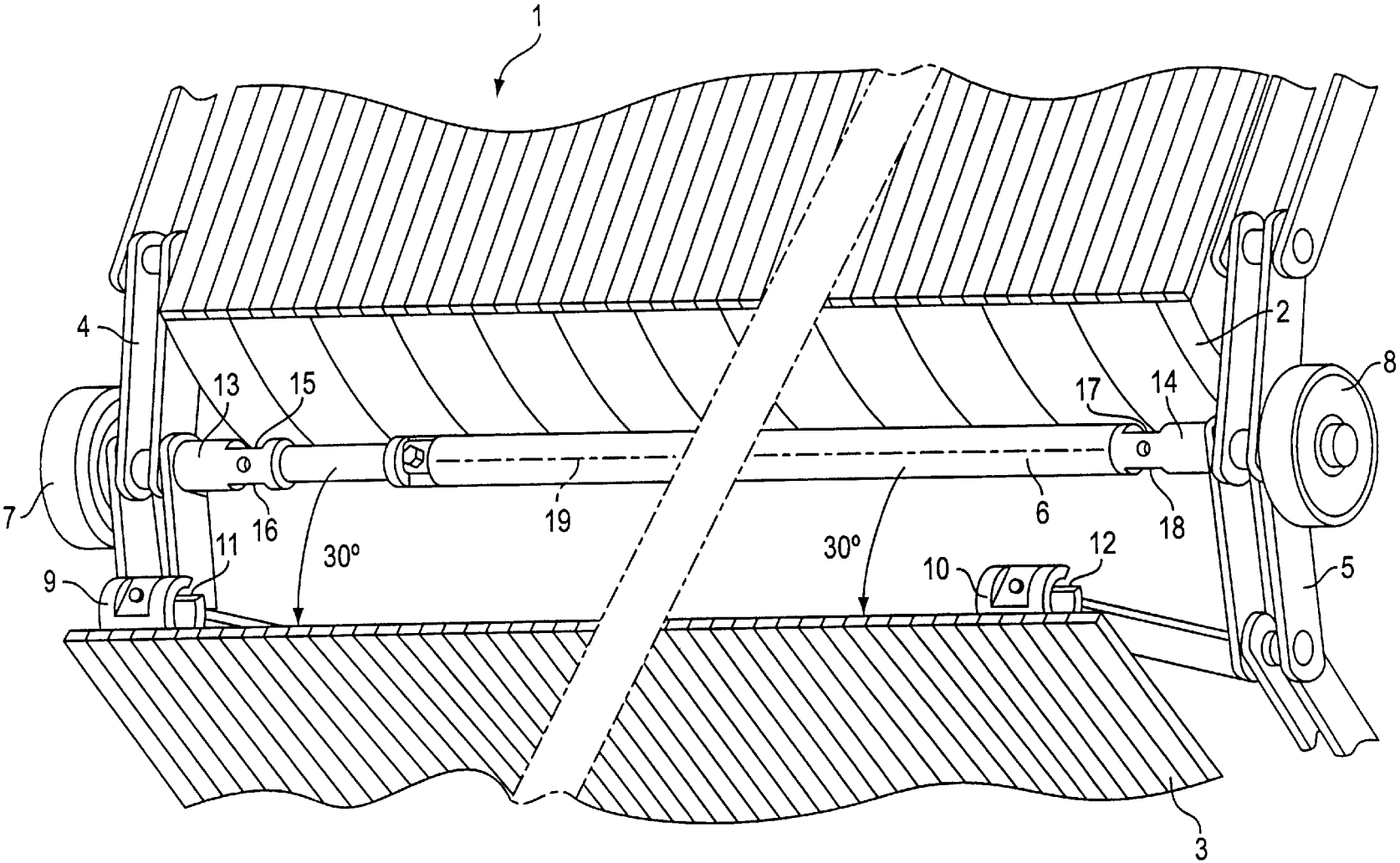
FIG. 1 is a perspective view which shows the traction elements with in-between arranged steps for an escalator that is not shown in more detail, while the installation of another pallet is indicated utilizing the principle of the invention.

FIG. 1 provides an inside view of the driving chain for an escalator 1 that is not shown in further detail (the same is true by analogy for a moving sidewalk), which comprises the following components:

Steps 2, 3, two traction elements 4, 5 in the form of articulated chains, axles 6 that extend between the traction elements 4, 5 as well as rollers 7, 8 in the outer region of the traction elements 4, 5. In the exemplary embodiment, the step 2 is already installed between the traction elements 4, 5, while the step 3 is in the process of being installed. The step 3 (analog also 2) is provided with assembly regions 9, 10 in the form of assembly eyelets, which are provided below the stepping surfaces. These assembly regions 9, 10 have been produced by injection-molding them together with the pallet body 3, wherein slot-shaped receiving opening, on slotted regions 11, 12 is provided in the assembly region 9, 10, into which the respectively corresponding axle region 13, 14 can be inserted. To permit a problem-free insertion, meaning the fitting of the slotted region 11, 12 onto the axle region 13, 14 that approximately corresponds to the diameter for the assembly eyelets, the axle regions 13, 14 have flattened zones 15, 16, 17, 18, that extend approximately parallel to each other. By fitting the slotted regions 11, 12 onto the flattened zones 15, 16 or 17, 18, and then turning of axle 6 around its longitudinal axis 19, it is thus possible to produce a form-locking connection between the axle regions 13, 14 and the assembly region 9, 10 for step 3.

Figures 2, 2A:
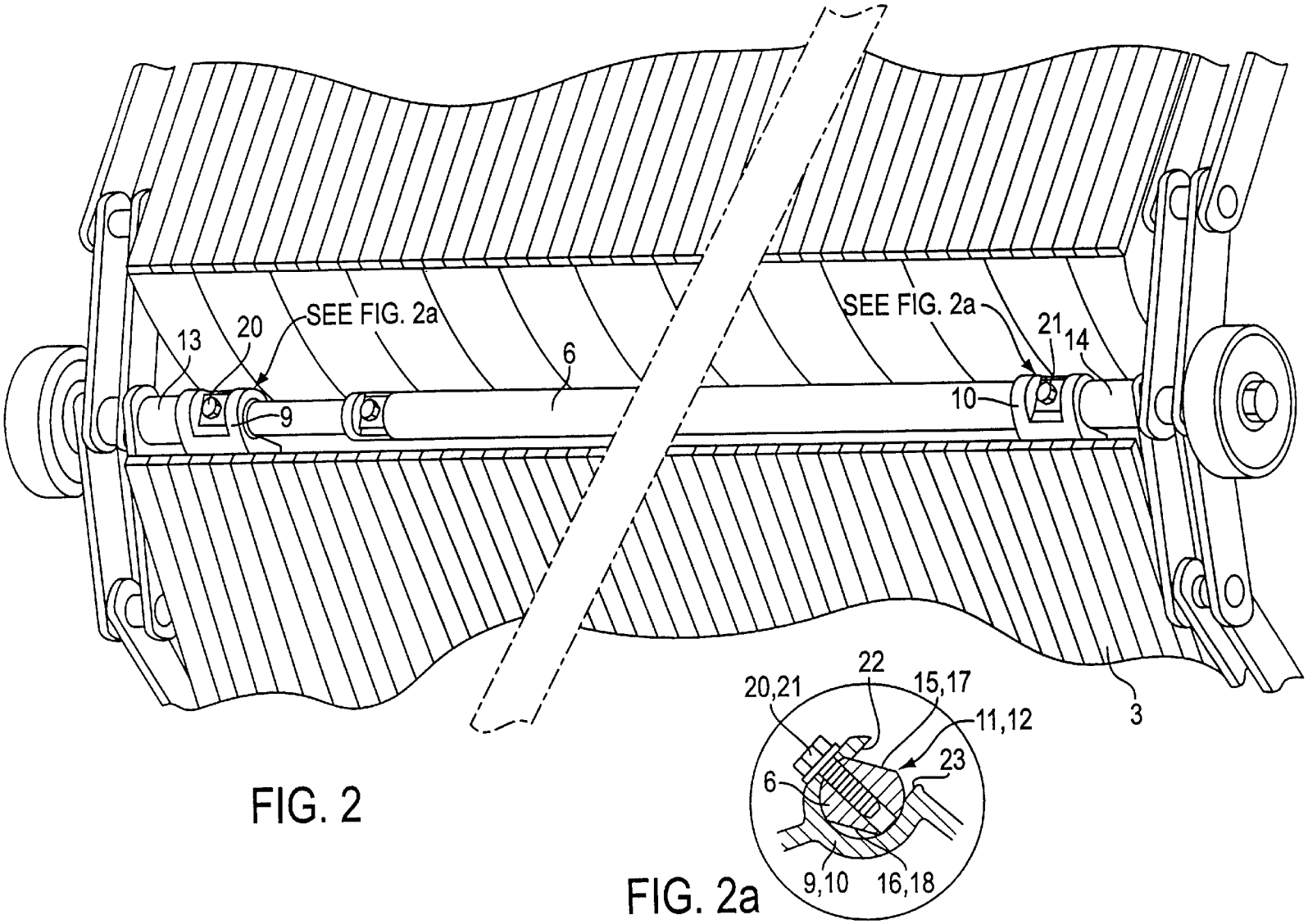
FIG. 2 is a perspective view which illustrates a step fitted onto and corrected with an axle according to the invention.
FIG. 2*a*is an enlarged cross sectional view of a portion of FIG. 2.

FIG. 2 shows the already installed step 3, which has been fitted with its assembly regions 9, 10 onto the axle regions 13, 14. Following the turning movement of the axle 6 relative to the assembly regions 9, 10 or the step 3, one screw 20, 21 respectively is inserted from the assembly region 9, 10 into the axle region 13, 14 as a safety element. The connection is shown in an enlarged illustration in FIG. 2*a*. The respective assembly region 9, 10, the axle 6 as well as the screws 20, 21 are visible. FIG. 2*a* furthermore shows that the flattened zones 15, 16 or 17, 18 no longer extend parallel to the surfaces 22, 23 of the slotted region 11, 12 of the assembly region 9, 10, so that an undesired slipping out of the axle 6 from the slotted region 11, 12 is avoided with certainty even if the connecting element 20, 21 is missing.

Figure 3:
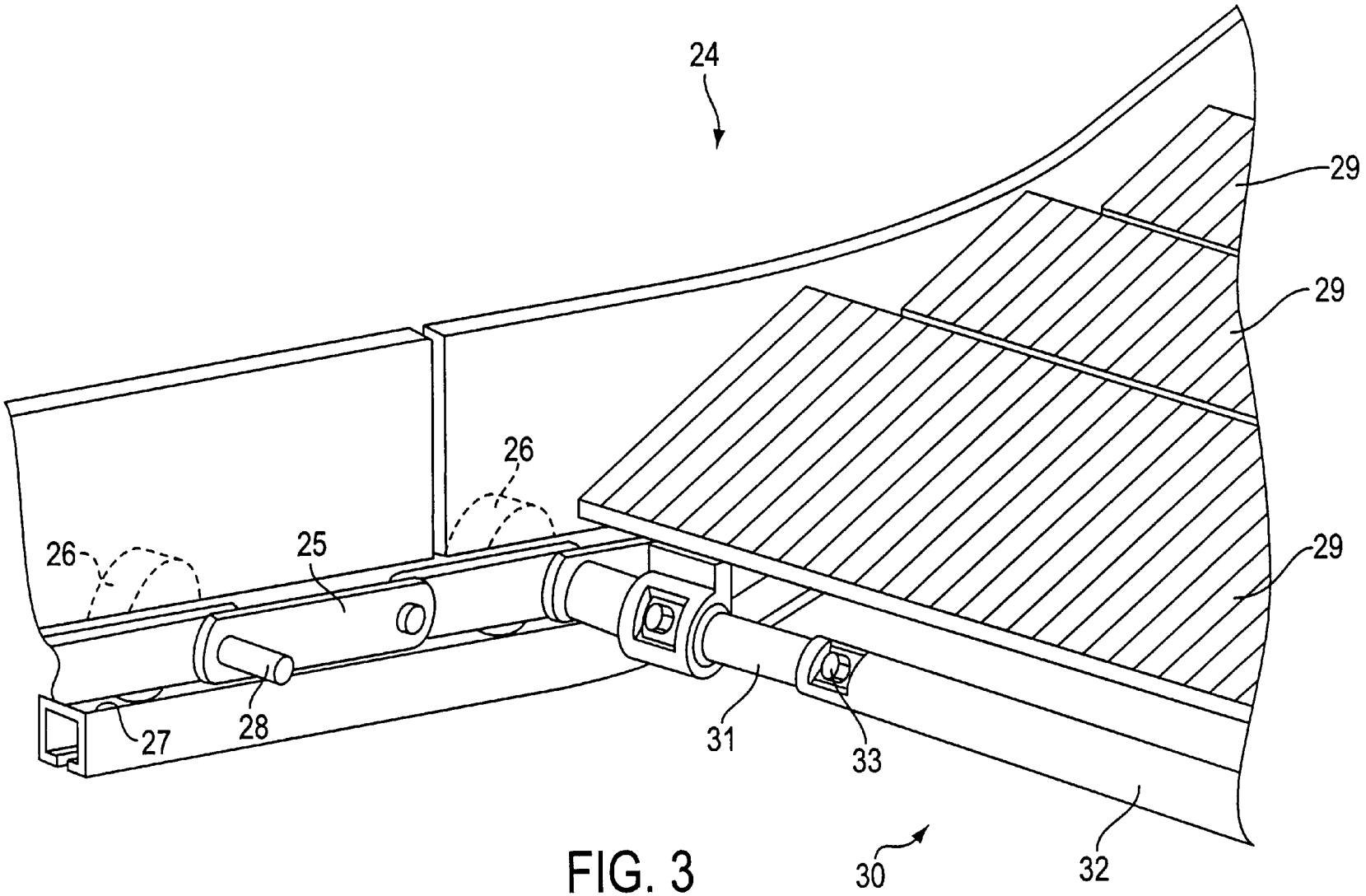
FIG. 3 is a perspective partial view of an escalator layout with steps provided on axles.

FIG. 3 provides an insight into the drive chain for an escalator 24 that is not shown further. Shown is a traction element 25 with rollers 26 that are arranged on the outside and which roll off on a corresponding guide track 27. Each roller is provided with an axle end 28, which extends through the traction element 25 and extends with a defined length in the direction of the steps 29 for escalator 24. The axle 30 in this example is formed by two tubes 31, 32 that can be moved relative to each other in a longitudinal direction, and which can be secured relative to each other via a connecting element, for example in the form of a screw 33.

Figure 4:
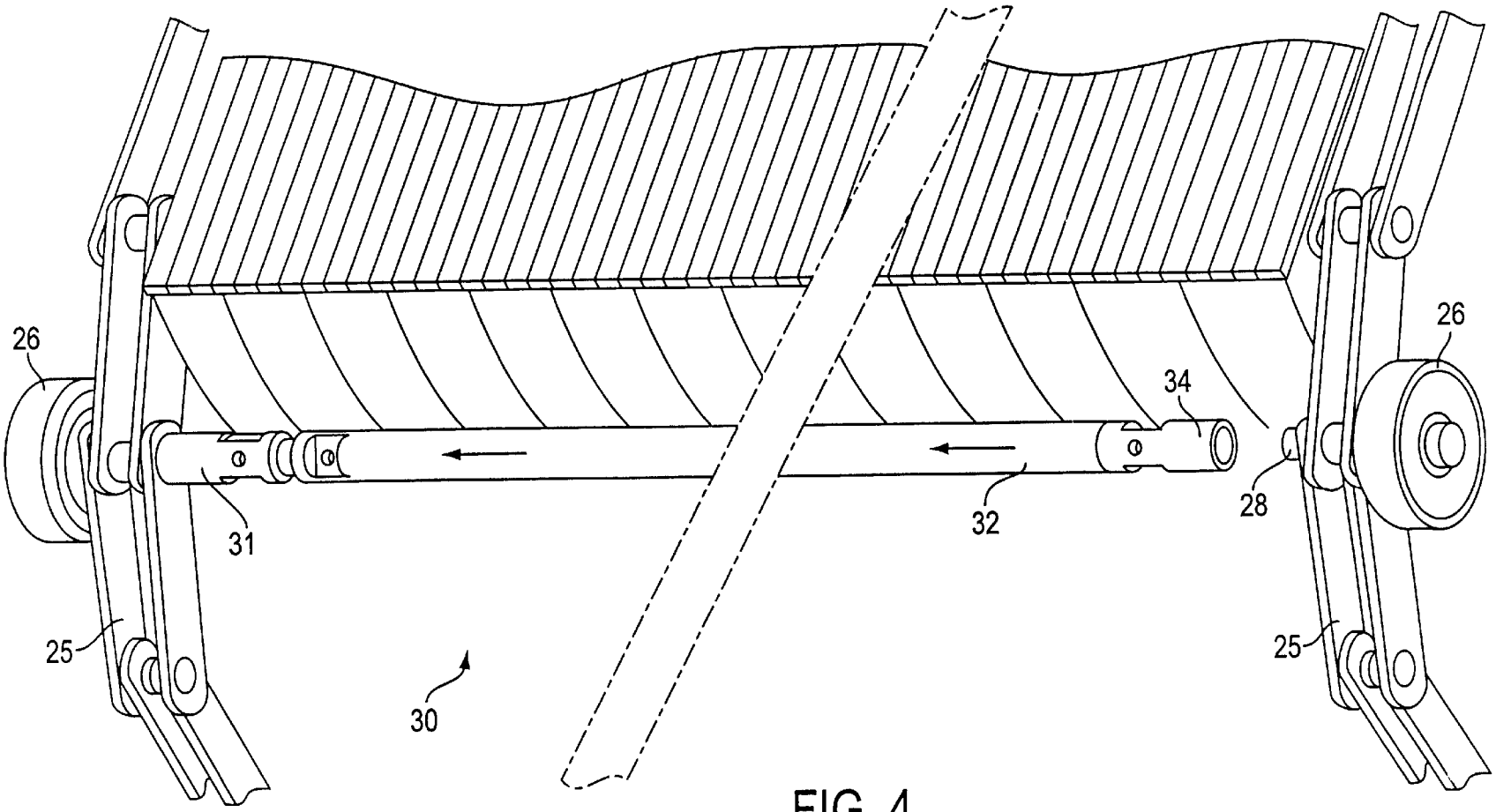
FIG. 4 is a perspective view illustrating the dismantling operation for an axle between escalator traction elements.

FIG. 4 shows the option of dismantling the axle 30 according to FIG. 3. The tube-shaped regions 31, 32 sit on the axle ends 28 for the rollers 26. By removing the connecting element 33, which is not shown here but can be seen in FIG. 3, the tube-shaped segment 32 can be moved relative to the tube-shaped segment 31 in the direction of the arrow, which releases its one end 34 from the axle end 28. Since there is now enough room, the other tube-shaped element 31 can then be pulled off the axle end that is not clearly recognizable here and can be removed from the area between the traction elements 25. The installation takes place in reverse order.

It will be understood that the above description of the present invention is susceptible to various modifications, changes and adaptations, and the same are intended to be comprehended within the meaning and region of equivalents of the appended claims.

What is claimed is:

1. Method for the assembly/dismantling of axles and/or steps or pallets of escalators or moving sidewalks, comprising: providing between parallel extending traction elements a plurality of axles and connecting the axles to the traction elements; providing the axles with flattened zones in assembly regions for the steps or pallets and providing the respective assembly regions with an approximately eyelet-shaped design that has a corresponding slot fitted onto the respective flattened zones for the axles; turning the axles at a predetermined angle around their longitudinal axis relative to the steps or pallets; and subsequently inserting at least one connecting element for securing the axles relative to the steps or pallets into each respective assembly regions.

2. Method according to claim 1, wherein the turning step includes turning the axles around their longitudinal axis until the flattened areas come to rest outside of the approximately parallel extending surfaces for the slots.

3. Method according to the claim 1, where the turning steps include turning the axles around their longitudinal axis by about 30°.

4. Method according to the claim 1, further including dismantling the steps or pallets by removing the connecting element, turning the axles back to their starting position and removing the steps or pallets from the flattened zones on the axles.

5. Method according to the claim 1, wherein the axles include at least two individual parts telescope together and secured relative to one another by a connection, and the method further includes dismantling the axles by initially releasing the connection between the individual parts and subsequently pushing the individual parts together telescopically to create a distance between the traction elements such that the axles can be pulled off receiving elements provided at the traction elements and removed from between the traction elements.

* * * * *

UNITED STATES PATENT AND TRADEMARK OFFICE

CERTIFICATE OF CORRECTION

PATENT NO : 5,944,164

DATED : August 31, 1999

INVENTOR(S) : Behle

It is certified that error appears in the above-identified patent and that said Letters Patent is hereby corrected as shown below:

On the title page, line [30], change the priority information to --German Application No. 196 08 169 filed March 4, 1996--.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*